US005573644A

United States Patent [19]

Poikolainen et al.

[11] Patent Number: 5,573,644

[45] Date of Patent: Nov. 12, 1996

[54] APPARATUS FOR GUIDING A WIRE

[75] Inventors: Antti Poikolainen; Kari Lamminmäki, both of Jyväskylä, Finland

[73] Assignee: Valmet Corporation, Helsinki, Finland

[21] Appl. No.: 350,273

[22] Filed: Dec. 5, 1994

[30] Foreign Application Priority Data

Dec. 3, 1993 [FI] Finland ..... U930584

[51] Int. Cl.[6] ..... D21F 1/32

[52] U.S. Cl. ..... 162/278; 162/279; 162/275

[58] Field of Search ..... 162/363, 364, 162/365, 366, 367, 368, 369, 372, 373, 272, 273, 274, 275, 278, 279, 297, 352; 15/300.1, 309.1, 315, 302, 303, 320; 34/85, 95, 623, 659; 134/198; 242/615, 615.3, 918

[56] References Cited

U.S. PATENT DOCUMENTS

| | | | |
|---|---|---|---|
| 3,630,838 | 12/1971 | Bryard et al. | 162/371 |
| 4,544,449 | 10/1985 | Arav | 162/374 |
| 4,988,408 | 1/1991 | Evalahti | 162/301 |
| 5,076,894 | 12/1991 | Simmons et al. | 162/352 |
| 5,120,401 | 6/1992 | Kiviranta et al. | 162/275 |
| 5,147,508 | 9/1992 | Sweet | 162/279 |
| 5,381,580 | 1/1995 | Kotitschke et al. | 15/309.1 |

FOREIGN PATENT DOCUMENTS

| | | |
|---|---|---|
| 82954 | 1/1991 | Finland . |
| 4018074 | 12/1991 | Germany . |
| 4101350 | 7/1992 | Germany . |
| 1018367 | 1/1966 | United Kingdom . |

*Primary Examiner*—Donald E. Czaja
*Assistant Examiner*—Calvin Padgett
*Attorney, Agent, or Firm*—Steinberg, Raskin & Davidson, P.C.

[57] ABSTRACT

An apparatus for guiding a wire including a device for producing a washing jet and a device for removing washing mist generated from the washing jet which has a suction box. The suction box is located on an opposite side of the wire from the device for producing a washing jet. The suction box has a duct through which the mist produced in the washing of the wire is passed into an inlet chamber. The duct is arranged at an angle, preferably at an acute angle, relative to the running direction of the wire. In conjunction with, a mist suction device, there is provided a list which is in contact with the wire and deflects the wire so that the direction of arrival of the wire at the list differs from the direction of departure of the wire from the list.

18 Claims, 5 Drawing Sheets

P
18
13a
14
17
16
15
13b
H
β
11
12
K1

APPARATUS FOR GUIDING A WIRE

BACKGROUND OF THE INVENTION

The present invention relates to apparatus for guiding a wire.

In the prior art, Finnish Patent Application No. 902000 which corresponds to U.S. Pat. No. 5,120,401, describes a mist suction apparatus used in association with a wire in which an oscillating washing jet is positioned on one side of a wire and a suction box is positioned on the other side of the wire. A washing mist produced by the washing jet during washing operation of the wire is gathered in the suction box by the effect of negative pressure therein. In association with the rotation of the wire, a separate mobile tension roll is used to adjust the tension of the wire. When the tension roll is moved, the inlet angle of the wire relative to the suction box of the mist suction apparatus also changes. Thus, in this prior art apparatus, it is a significant disadvantage that the wire may therefore be moved too far from the suction box and out of contact therewith.

OBJECTS AND SUMMARY OF THE INVENTION

It is an object of the present invention to eliminate the disadvantage of the prior art apparatus discussed above, in particular to ensure that the suction box does not become overly distanced from the wire.

Accordingly, in the present invention, a wire is brought in contact with a list, i.e., a band or strip of material, in association with the mist suction means, whereby the list serves as a folding or deflecting element for the wire so that the direction of the wire is changed at the list. The wire remains in contact with the list in various adjustment positions of the wire tension roll, and thus, operation of the mist suction means is not disturbed during movement of the tension roll.

The list may also be used in separation activities, in which case it can replace the guide roll. The procedure is advantageous particularly in renewing machines which need a lot of space so that a narrow list in accordance with the invention will not take a lot of space, and it may be placed in the vicinity of machine beams.

In a preferred embodiment, the list is made of a ceramic material, e.g., SiC, $SIN_4$, $A1_2O_3$, $ZrO_2$ and mixtures thereof.

An application of the invention is to use a crownable list, i.e., one in which the profile in a direction transverse to the machine direction can be varied. The list can thus be made arched in order to guide the wire. The crowning of the list can be accomplished, e.g., by an actuating cylinder located in the center area of the list while ends of the list are fixed in place.

Briefly, the apparatus in accordance with the invention for guiding a wire comprises a list positioned in association with mist suction means and in contact with the wire. The direction of the wire moving to the list deviates from the direction of the wire moving away from the list, so that the list serves to fold the wire and provide a non-linear running path from the preceding and subsequent stationary press elements, e.g., tension adjustment roll and guide roll, respectively.

In a preferred embodiment, the list is fixedly connected to the suction box of the mist suction means and is arranged in front of an inlet opening of a duct connecting to the inlet chamber in the suction box in the running direction of the wire. Also, the list is preferably in continuous contact with the wire.

The invention is described below by referring to certain preferred embodiments of the invention presented in the figures of the accompanying drawings. However, the invention is not intended to be exclusively confined to these illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
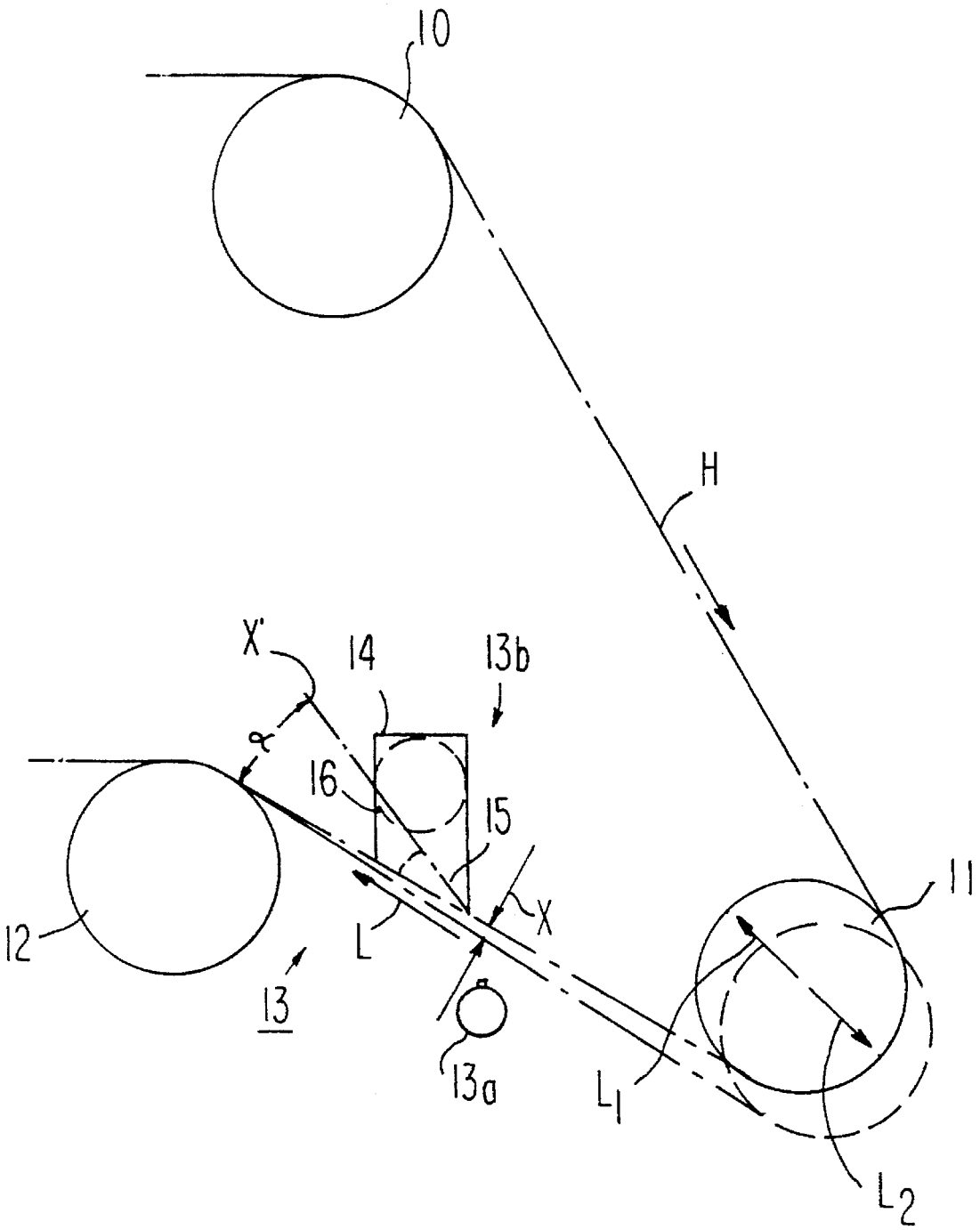
FIG. 1 PRIOR ART
FIG. 1 is a prior art tension adjustment arrangement for a wire in association with mist suction means.

FIG. 1 shows a prior art arrangement and particularly the area in which the wire separates from association with the suction box during movement of the tension adjustment roll. A wire H is conducted via rolls 10, 11 and 12. Roll 11 is a tension adjustment roll and roll 12 is a tension measurement roll of the wire H. When adjusting the tension of the wire, i.e., during running thereof, the tension adjustment roll 11 of the wire is moved in direction $L_1$ or $L_2$ as shown in FIG. 1. The tension thus achieved is measured by the tension measurement roll 12. However, it is evident that this adjustment of tension roll 11 causes a displacement X of the wire H thereby detaching the wire from being in connection with mist suction equipment and specifically a suction box 14. The mist suction equipment 13 also comprises means **13*a* for producing an oscillating washing jet arranged on an opposite side of the wire from the suction box, and on the other side of the wire, means 13*b* to remove the washing mist., e.g., suction box 14. The washing jet is directed at the wire H to cleanse the same and then the washing mist thus produced is drawn by a vacuum, i.e., negative pressure, into the suction box 14. The mist is conducted into a duct 15 opening at one end into a washing mist inlet chamber 16 within the suction box 14 and opening at an opposite end in the vicinity of the wire in a lower surface of the suction box 14**.

When the position of the wire H in the wire tensioning adjustment is changed, the distance of the wire H from the suction box 14 also changes thereby disturbing the discharge of the washing mist into the suction box 14. There is an acute angle $\alpha$ between the longitudinal axis X' of the duct 15 and the principal direction of travel, i.e., the running direction, L of the wire H. The angle opens in the running direction L of the wire H and is preferably in the range of between about 20° and about 70°. The oblique positioning of the duct 15 makes it possible to utilize the velocity component imparted by the wire H to the washing mist and to guide the mist efficiently into the suction box and further away from the washing point.

Figure 2:
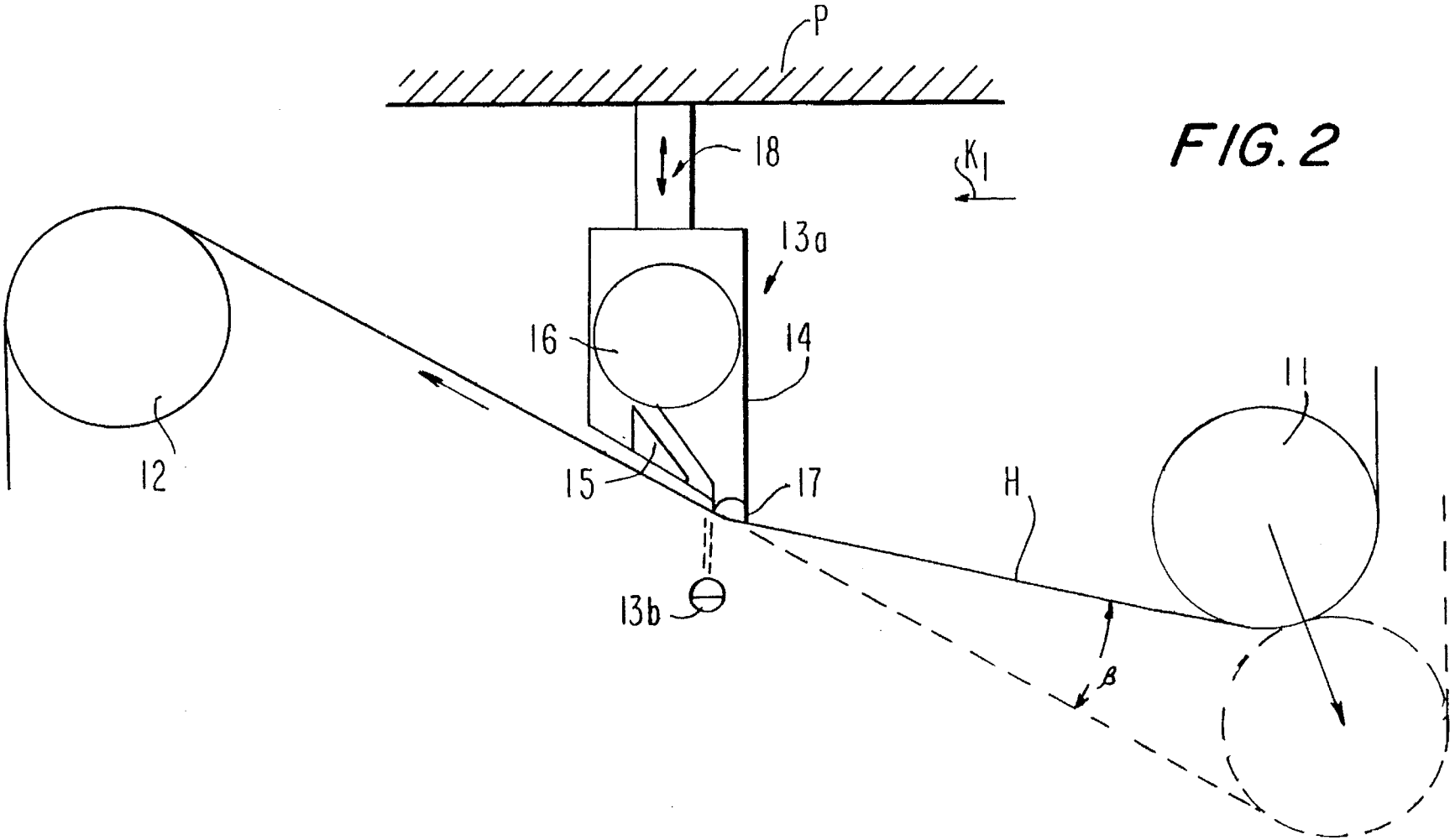
FIG. 2 is an apparatus in accordance with the present invention.

FIG. 2 illustrates the apparatus in accordance with the invention wherein the arrangement comprises a list 17 arranged in association with a front edge 14*a* of the suction box 14. List 17 is in contact with the wire H. A list fabricated from ceramic material is advantageously used because the ceramic material withstands wearing. The suction box 14 of the mist suction means 13 and the list 17 are positioned close to the wire H so that the entry direction of the wire H to the list 17 is not the same as the exit direction of the wire H from the list 17. Thus, the list 17 folds or deflects the wire H, i.e., provides the wire with a non-linear path. At the least, the list 17 contacts the wire H.

As shown in FIG. 2, during tension adjustment when the tension adjustment roll 11 is displaced (as shown by the broken line), the tension roll 12 of the wire H is maintained in its position. As a result of this arrangement, during tension adjustment of the wire H, the wire H is kept close to the list 17 and thus to the suction box 14.

In the invention, the passage of the wire H is adjustable and can be further guided with the list 17 in a manner similar to the guiding obtained by the use of crowned rolls. This is made possible by arranging actuating means 18 for crowning the list 17, e.g., in a center area of the list 17 in the length direction thereof. The crowning is accomplished by tensioning the suction box 14 in the center area thereof so that the list 17, which is attached to the suction box 14 is arched in the center area. The crowning can be either negative or positive, i.e., the center area of the list can be adjusted to provide either a concave or convex surface, depending on the manner desired to affect the passage of the wire H.

Figure 3:
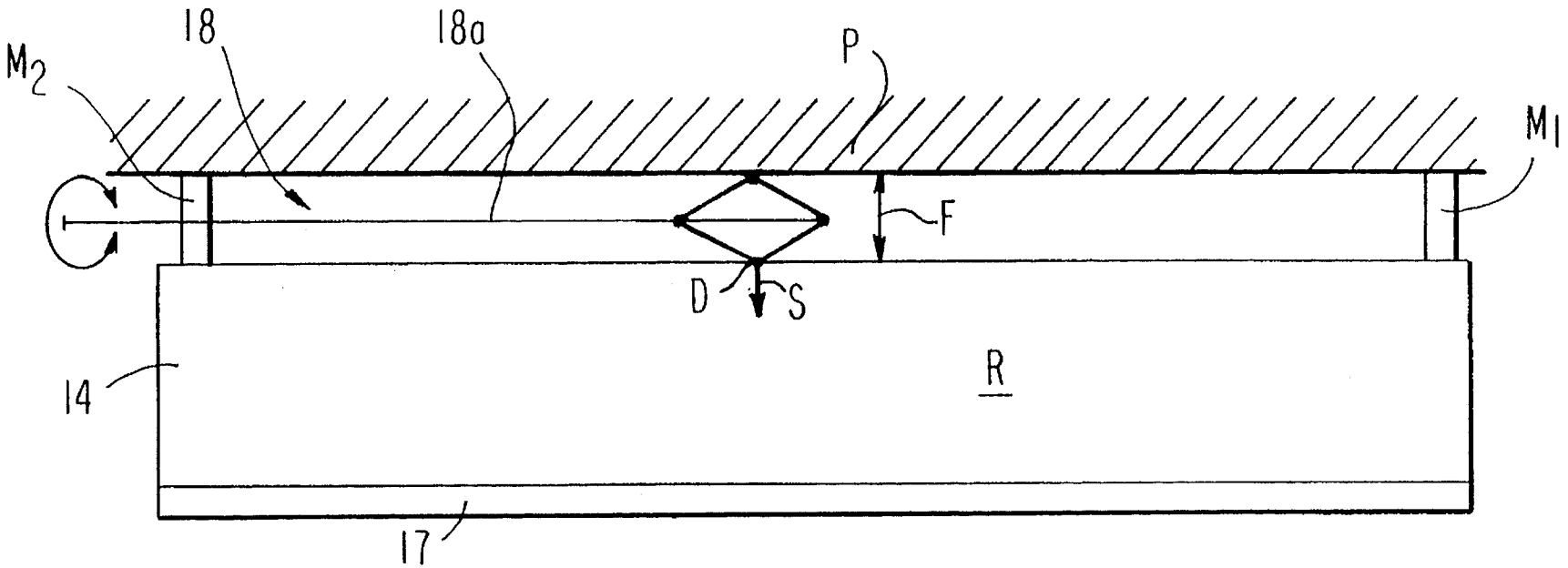
FIG. 3 is a view in the direction of arrow $K_1$ shown in FIG. 2.

FIG. 3 shows the apparatus of FIG. 2 in the direction of arrow $K_1$. The suction box 14 is attached at its ends by attachment members $M_2$ and $M_2$ to a transverse beam P of the paper-making machine. An actuator 18 is placed in the center of the suction box 14 of the mist suction means 13, with respect to the length of a frame R of the suction box 14, in an area F between the transverse beam P of the paper-making machine and the frame R of the suction box 14, and also between the attachment members $M_1$ and $M_2$. The actuator 18 may be for instance a claw crane, whereby by rotating a screw 18*a*, a connection point D is displaced in direction S and in that manner, the frame R of the suction box 14 of the mist suction means 13 is arched. In view of the connection between the suction box 14 and the list 17, the list 17 is also arched to provide the negative or positive crown-variation.

Figure 4:
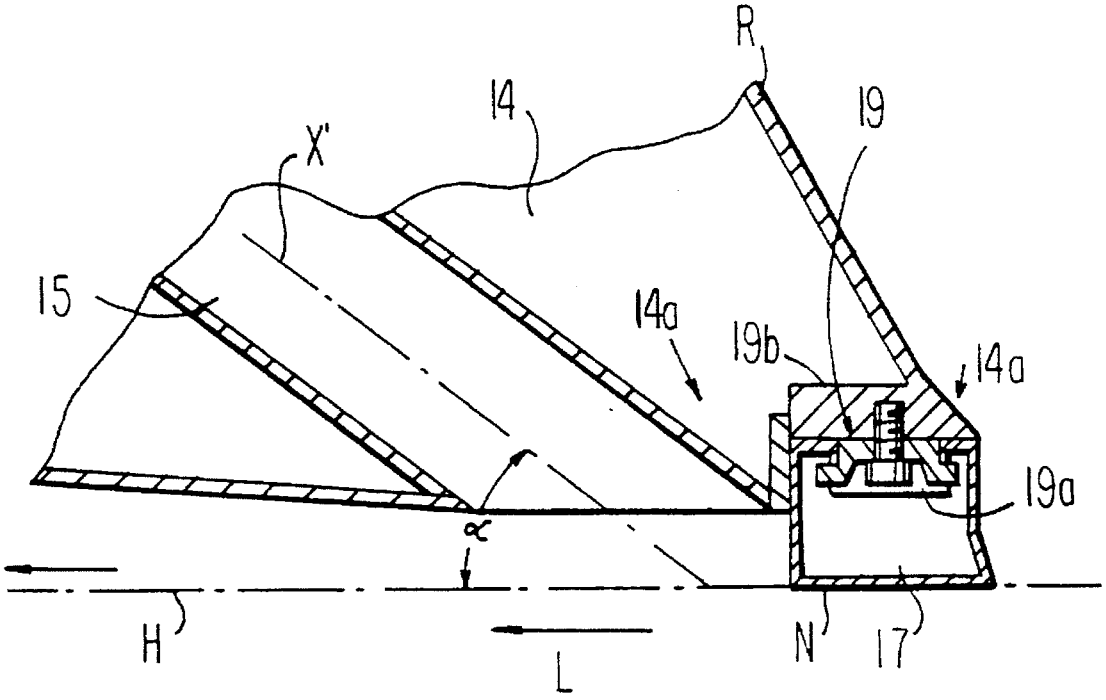
FIG. 4 is an illustration of the attachment of the list in the apparatus in accordance with the invention on the front edge of a frame beam of the mist suction means.

FIG. 4 illustrates the fixing arrangement of the list to the front edge 14*a* of the suction box 14 of the mist suction means 13 utilizing a T-rail joint 19. In this construction, the list 17 comprises a T-groove 19*a* which is disposable in counter-joining means 19*b*, preferably a rail having a corresponding cross-sectional shape, located in the frame R. The connection between the list 17 and the front edge 14*a* of the suction box 14 may also be a so called dovetail joint. Both the T-rail joint and the dovetail joint enable quick replacement of list 17 when necessary and thus constitute means for removably connecting the list to the suction box. A locking screw may be used to fixedly connect the rail 19*b* to the front edge 14*a* of the suction box 14.

As shown in FIG. 4, the list 17 comprises a large face N which lies against the wire H. The list 17 has preferably a rectangular cross-sectional shape and extends over substantially the entire width of the wire. The width of the face N is preferably about 10 to about 60 mm. One purpose of the list 17 is to improve the generation of suction in the suction box and to prevent the flow of air into the suction box from locations other than from that portion of the list which is situated on the side of the duct 15. Accordingly, the list 17 serves as a certain kind of closing part. Another purpose of the list is to serve as a member deflecting the wire. Thus, the face N of the list 17 is against the wire H, and the list 17 functions as a wire-deflecting member so that between the direction of arrival of the wire H at the list 17 and the direction of departure of the wire H from the list 17, there is an angle $\beta$ that is about 0.5° or preferably even larger. When the tension of the wire is then adjusted by means of the roll 11, the wire H is always maintained in contact with the list 17 and the list 17 thus always has a precise position relative to the wire independently of the adjustment of the tension of the wire. Thus, the list 17 has a wide face N in a direction transverse to its longitudinal direction adapted to contact the wire and also projects from a lower surface of the suction box 14 to define a space between the wire H and the opening of the duct 15 in the lower surface of the suction box 14, as shown in FIG. 4.

Figure 5:
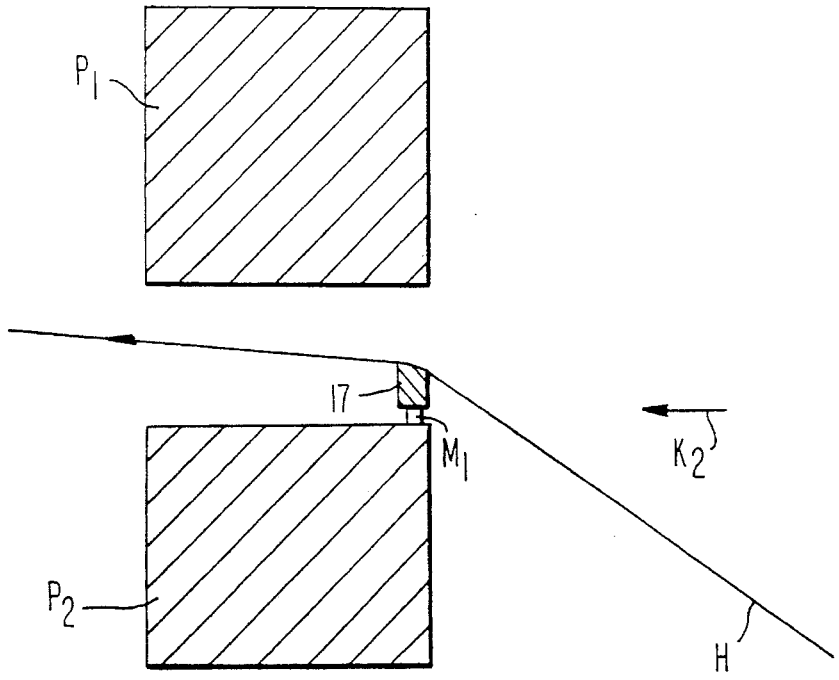
FIG. 5 is another embodiment of the apparatus in accordance with the invention in which the guide roll is replaced by a list, and is a view taken along the section line I—I in FIG. 6.
Figure 6:
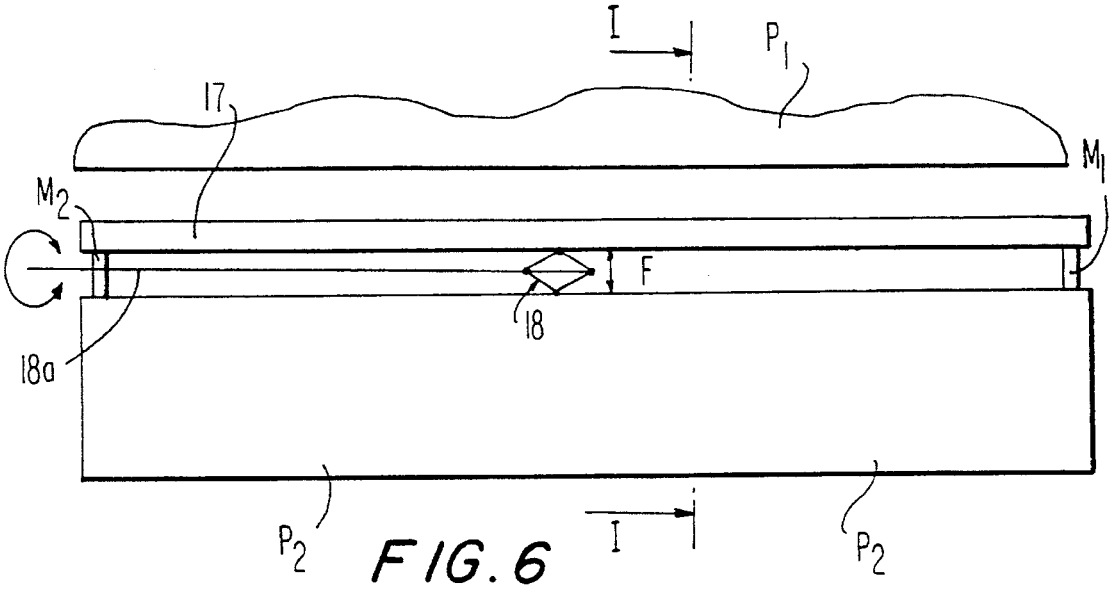
FIG. 6 is a view in the direction of arrow $K_2$ shown in FIG. 5.

FIG. 5 illustrates the list 17 of the invention placed between frame beams $P_1$ and $P_2$ of a paper-making machine replacing a folding or deflecting roll of the wire H. The illustration is a sectional view taken along the line I—I from FIG. 6. FIG. 6 shows a view in the direction of arrow $K_2$ shown in FIG. 5. The list 17 can be crowned with an actuator 18, e.g., with a cylindrical means or, as shown in FIG. 6, with a claw crane. The actuator is located in the center area of the list 17 between the frame beam $P_2$ of the paper making machine and the list 17. The list 17 is attached at its ends by attaching members $M_1$ and $M_2$ to the beam $P_2$. The claw crane 18, which is situated in the center area of the list between the list 17 and the frame beam $P_2$, is positionable by turning a screw 18*a* of the claw crane 18 on the service side of the paper-making machine. The actuator 18 may also be a double-acting hydraulic cylinder or a pneumatic cylinder, or an electrically driven actuator.

According to the invention, the list 17 is preferably made of a ceramic material, e.g., SiC, $SiN_4$, $Al_2O_3$, $ZrO_2$, or a combination thereof, such as $ZrO_2$+$Al_2O_3$. The list 17 may also be made of spray coated steel, a carbon fiber compound or plastic.

The examples provided above are not meant to be exclusive. Many other variations of the present invention would be obvious to those skilled in the art, and are contemplated to be within tile scope of the appended claims.

We claim:

1. In an apparatus for washing and guiding a wire comprising means for producing and directing a washing jet at a wire and means for removing washing mist from the wire including a suction box situated on an opposite side of the wire from said washing jet producing and directing means, said suction box including an inlet chamber and a duct through which washing mist produced from the washing jet is passed into said inlet chamber, said duct being arranged at an angle relative to a running direction of the wire over said suction box and having an opening in a lower surface of said suction box facing the wire, the improvement comprising an elongate list arranged in conjunction with said means for removing washing mist, said list having a wide face in a direction transverse to its longitudinal direction such that at least a portion of said list continuously contacts the wire, said list projecting from said lower surface of said suction box to define a space between the wire and said opening of said duct in said lower surface of said suction box and to deflect the wire such that a direction of arrival of the wire at said list differs from a direction of departure of the wire from said list.

2. The apparatus of claim 1, wherein an angle of deflection of the wire about said list is defined between the direction of arrival of the wire at said list and the direction of departure of the wire from the list, said deflection angle being greater than or equal to about 0.5°.

3. The apparatus of claim 1, wherein said list is fixedly connected to said suction box, said duct having an inlet opening, said list being arranged in front of said inlet opening in a running direction of the wire.

4. The apparatus of claim 1, further comprising a rail arranged on said suction box and having a T-profile cross-sectional shape, said list comprising a groove having a corresponding shape to enable said list to engage with said suction box via a connection between said T-profile rail and said groove.

5. The apparatus of claim 1, further comprising actuator means for providing said list with a crown.

6. The apparatus of claim 5, further comprising attachment means for attaching said suction box to a machine frame while maintaining a space therebetween, said list being connected to said suction box, said actuator means being arranged to operate in said space to bend said suction box such that when said suction box is bent, said list connected thereto is provided with a curved profile.

7. The apparatus of claim 6, wherein said suction box has first and second ends, said attachment means comprising attachmeant members arranged at said first and second ends of said suction box, said actuator means being arranged in a center region of said suction box between said attachment members.

8. The apparatus of claim 6, wherein said actuator means comprise a claw crane.

9. The apparatus of claim 1, wherein said list is made of plastic.

10. The apparatus of claim 1, wherein said list is made of a ceramic material.

11. The apparatus of claim 1, wherein the length of said face is from about 10 mm to about 60 mm in a running direction of the wire.

12. The apparatus of claim 1, further comprising means for removably connecting said list to said suction box.

13. The apparatus of claim 1, wherein said list is positioned at a front edge of said lower surface of said suction box, said space being defined after said list in a running direction of the wire.

14. An apparatus for washing and guiding a wire, comprising means for producing and directing a washing jet at a wire, said means being positioned on a first side of the wire, means for removing washing mist generated from the washing jet from the wire, said means for removing washing mist including a suction box situated on a second side of the wire opposite from said first side, said suction box including an inlet chamber and a duct through which the washing mist is passed into said inlet chamber, said duct having an opening in a lower surface of said suction box facing the wire, and p1 a list coupled to said means for removing washing mist and having a wide face in a direction transverse to its longitudinal direction such that at least a portion of said list continuously contacts the wire, said list projecting from said lower surface of said suction box to define a space between the wire and said opening of said duct in said lower surface of said suction box and to deflect the wire such that a direction of arrival of the wire at said list differs from a direction of departure of the wire from said list.

15. The apparatus of claim 14, wherein said list is fixedly connected to said suction box.

16. The apparatus of claim 14, further comprising actuator means for providing said list with a crown, and means for attaching said suction box to a machine frame while maintaining a space therebetween, said actuator means being arranged to operate in said space to bend said suction box such that when said suction box is bent, said list is provided with a curved profile.

17. The apparatus of claim 14, wherein the length of said face is from about 10 mm to about 60 mm in a running direction of the wire.

18. The apparatus of claim 14, further comprising means for removably connecting said list to said suction box.

* * * * *